United States Patent [19]

Friendship

[11] Patent Number: 4,531,650

[45] Date of Patent: Jul. 30, 1985

[54] PLASTIC CAP WITH PRESSURE SEAL

[75] Inventor: Kenneth F. M. Friendship, Simsbury, Conn.

[73] Assignee: The Continental Group, Inc., New York, N.Y.

[21] Appl. No.: 191,197

[22] Filed: Sep. 26, 1980

Related U.S. Application Data

[63] Continuation of Ser. No. 910,520, May 30, 1978, abandoned.

[51] Int. Cl.[3] ..... B65D 41/48

[52] U.S. Cl. ..... 215/256; 215/270; 215/321

[58] Field of Search ..... 215/31, 253-256, 215/270, 271, 316, 317, 321, 341-344, DIG. 1, 1 C

[56] References Cited

U.S. PATENT DOCUMENTS

| | | | |
|---|---|---|---|
| 3,197,055 | 7/1965 | Kelly | 215/256 |
| 3,263,724 | 8/1966 | Mojonnier et al. | 215/31 X |
| 3,298,415 | 1/1967 | Klygis | 215/321 X |
| 3,707,240 | 12/1972 | Wilson | 215/344 X |
| 3,727,784 | 4/1973 | Sargent | 215/DIG. 1 |
| 3,784,038 | 1/1974 | Uhlig | 215/31 X |
| 3,991,904 | 11/1976 | Davis et al. | 215/256 X |
| 4,043,475 | 8/1977 | Wheeler | 215/256 X |
| 4,106,654 | 8/1978 | Jones | 215/341 X |
| 4,162,736 | 7/1979 | Faulstich | 215/31 X |

FOREIGN PATENT DOCUMENTS

| | | | |
|---|---|---|---|
| 209870 | 8/1957 | Australia | 215/DIG. 1 |
| 697431 | 11/1964 | Canada | 215/317 |
| 1049059 | 12/1953 | France | 215/DIG. 1 |
| 6500918 | 7/1965 | Netherlands | 215/321 |
| 812090 | 4/1959 | United Kingdom | 215/DIG. 1 |
| 1039022 | 8/1966 | United Kingdom | 215/DIG. 1 |

*Primary Examiner*—William Price
*Assistant Examiner*—Gary E. Elkins
*Attorney, Agent, or Firm*—Charles E. Brown

[57] ABSTRACT

This disclosure relates to a closure formed of plastics material for use in conjunction with a container also formed of a plastics material. The closure is particularly adapted for use with containers in the form of bottles which are intended to have a product packaged therein under pressurized conditions. The closure cooperates with a lip of the bottle so as to radially inwardly deform the lip with the exterior surface of the lip forming a seal with the closure. The portion of the closure engaging the lip is drawn radially inwardly under pressure by the axial deformation of an end panel of the closure.

13 Claims, 8 Drawing Figures

PLASTIC CAP WITH PRESSURE SEAL

This is a continuation of Ser. No. 910,520, filed May 30, 1978, now abandoned.

This invention relates in general to new and useful improvements in closures for containers, and more specifically to a closure which is formed of plastics material and is particularly adapted for use in closing a beverage bottle also formed of plastics material.

There have already been developed metal closures which when applied to beverage bottles formed of plastics material will form a seal therewith. However, in conjunction with metal closures it is still necessary to provide a sealing material within the metal closure and for the sealing material to engage the axial extremity of the bottle lip.

It is also known to form container closures of plastics material as is clearly disclosed in the U.S. Pat. No. 3,893,583 to McLaren of July 8, 1975. Further, the closure of the McLaren patent is provided with a tamper indicating band which is so related to the closure that the closure cannot be removed from the associated container without removal of the band.

In accordance with this invention it is proposed to provide a closure for a beverage bottle which closure is formed of plastics material and is particularly configurated to cooperate with a plastics material bottle to form a lasting seal therewith which is sufficient to resist high internal pressures within the bottle even when the bottle is provided with a mouth having an internal diameter on the order of 38 mm. There have been developed in recent years bottles formed of plastics material which have the necessary properties for forming a container for beverages under pressure. The bottle, while the plastics material thereof is quite hard, has posed a problem in the efficient application of closures thereto. Such bottles are normally formed of polyethylene terephthalate or other FDA-approved plastics material. In accordance with this invention, it is proposed to provide a closure which is formed of plastics material and is so constructed wherein not only may it be efficiently molded at a comparatively low cost, but also it may be readily applied to existing plastic bottles at a greatly reduced application pressure.

One of the features of the invention is the seal which is effected between the closure and the lip of the bottle. The closure is provided internally with a wedge-shaped portion which engages the exterior of the lip of the bottle, and when applied, radially inwardly compresses and deflects the lip of the bottle with the seal between the closure of the bottle being between the exterior surface of the lip and the wedge surface of the closure. No seal is formed between the axial end of the lip and the end panel of the closure, thereby eliminating the need for the customary sealing ring or layer applied to the end panel of the closure cap.

Another feature of the invention is that the neck finish of the plastics material bottle may be formed with a tapered lip, the lip tapering to almost a point at its axial end, thereby effecting a savings in material in the formation of the bottle.

Another feature of the invention is that the end panel of the closure is made sufficiently thick to retain internal pressures and provide a barrier to resist the permeation of oxygen or carbon dioxide, but at the same time sufficiently thin so as to axially deform, drawing the wedge surface radially inwardly to tighten the seal by way of the pressure within the bottle. This continuous drawing in of the wedge surface of the closure overcomes deficiencies of seals which frequently lose their sealing efficiency after a time due to the inherent creep properties of the plastics material, with a corresponding increase of torque necessary to remove the closure.

A further feature of the closure is the provision of a retaining ring which is permanently interlocked with the bottle so as to prevent blow-off of the closure when opening the bottle under high pressure conditions. Associated with the retaining ring and disposed between the retaining ring and the skirt of the closure is a removable tear strip which has the dual function of making the closure tamper-proof and aiding in the retention of the closure in place against high internal pressures within the bottle.

With the above and other objects in view that will hereinafter appear, the nature of the invention will be more clearly understood by reference to the following detailed description, the appended claims, and the several views illustrated in the accompanying drawings.

Figure 1:
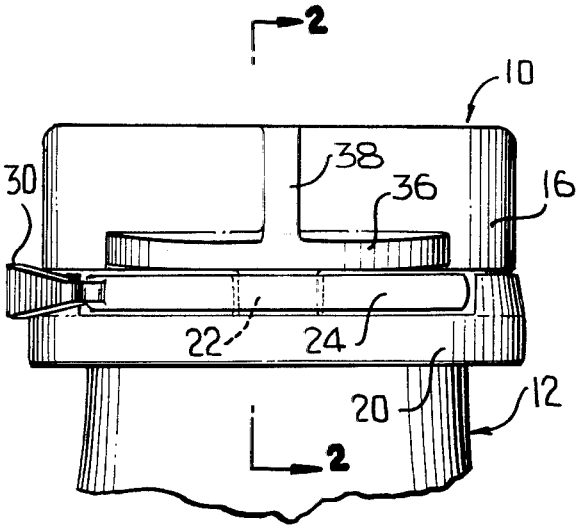
FIG. 1 is a front elevational view of the closure applied to a bottle, only the neck portion of the bottle being shown.

Referring now to the drawings in detail, it will be seen that the closure is generally identified by the numeral 10 and the container is generally identified by the numeral 12. The closure 10 is in the form of a cap and includes an end panel 14 and a depending skirt 16. Spaced axially from the skirt 16 is a retaining ring 20 which is permanently secured to the lower edge of the skirt by means of a retaining band or hinge 22. Disposed coplanar with the retaining band 22 and positioned between the retaining ring 20 and the lower edge of the skirt 16 is a tear strip 24. The tear strip 24 is connected to the skirt 16 by a weakening line 26 and to the retaining ring 20 by a weakening line 28. One end of the tear strip 24 is provided with a projecting lug 30 which extends radially outwardly of the cap or closure 10 and which may be readily gripped to facilitate the tearing out of the tear strip 24.

Figure 6:
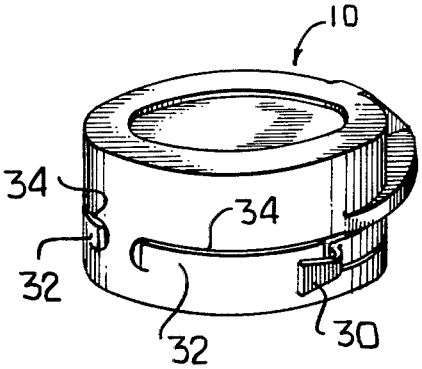
FIG. 6 is a rear perspective view of the closure.

As is clearly shown in FIGS. 1 and 6, the tear strip 24 extends only partially about the circumference of the cap 10 and both ends thereof are spaced from the retaining band 22. Between the retaining band 22 and the ends of the tear strip 24, the retaining ring 20 has upwardly projecting portions 32 which are disposed immediately adjacent the skirt 16 and are connected thereto by lines of weakening 34 (FIG. 6).

At this time it is to be understood that the closure 10 has an interlocking engagement with the container 12 and is removed by first tearing out the tear strip 24 and then lifting the front part of the skirt 16 by means of a lug 36 which is integrally connected to a lower forward part of the skirt 16. The lug 36 is stiffened by a rib 38.

Figure 7:
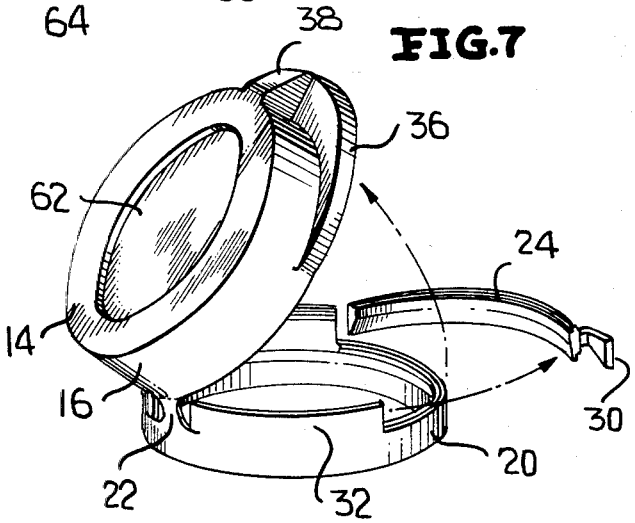
FIG. 7 is another rear perspective view of the closure with the tear strip removed and the sealing portion of the closure pivoted relative to the retaining ring to an opened position.

When the upper portion of the closure 10 is separated from the container 12, it remains attached thereto by way of the retaining band 20 and hinges relative to the retaining band 20 in the manner best shown in FIG. 7. As the upper part of the closure is raised, the skirt 16 separates from the retaining band 20 by the gradual rupture of the lines of weakening 34.

Figure 8:
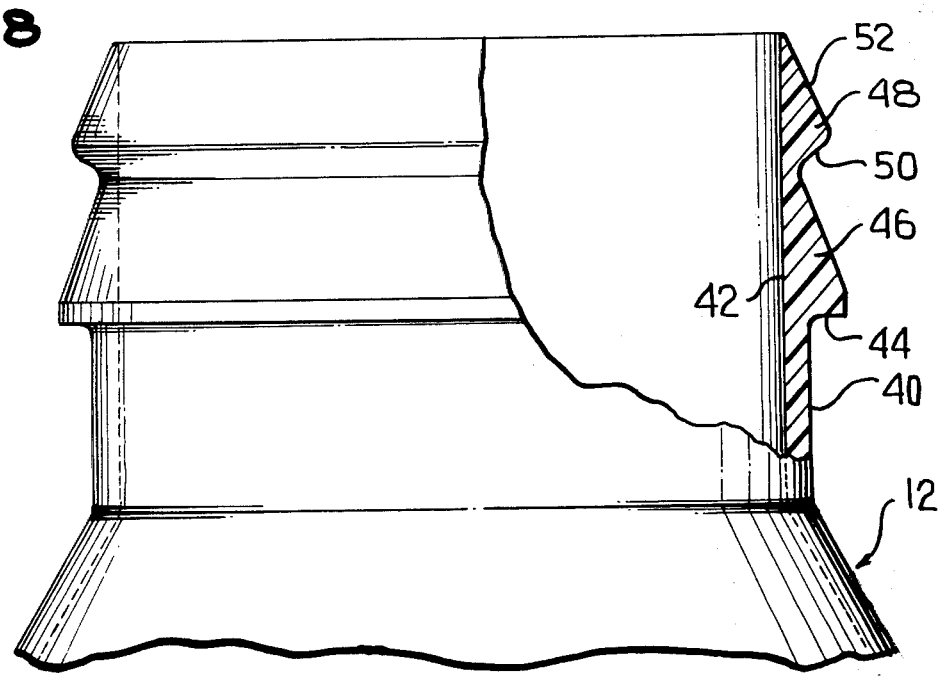
FIG. 8 is an enlarged fragmentary elevational view with parts broken away and shown in section of the neck of the bottle.

The closure 10 is particularly adapted for use with a container 12 in the form of a beverage bottle which is intended to have packaged therein beverages, such as soft drinks, under pressure. The neck finish of the container 12 is best illustrated in FIG. 8 and includes a cylindrical neck portion 40 with a constant diameter throat 42. Above the cylindrical neck 40 the neck finish includes a lower shoulder 44 which is formed on the underside of a tapered exterior portion 46 which, together with an upper tapered portion 48, defines a further shoulder 50. It is particularly pointed out here that the upper tapered portion 48 defines a radially inwardly and upwardly sloping sealing surface 52 and that the thickness of the tapered upper portion 48 approaches zero at the lip end of the neck finish.

The formation of the neck finish of the container 12 so as to be tapered results in a savings of material.

It is pointed out here at this time that the present containers which are in the form of carbonated beverage bottles are formed of suitable plastics material with the most widely used plastics material being polyethylene terephthalate, which is a relatively hard material in its molded state. It is proposed to form the closure cap of plastics material which is softer than the plastics material of the container 12, and it has been found that polyethylene or other suitable plastics material may be used in the formation of the closure.

Figure 2:
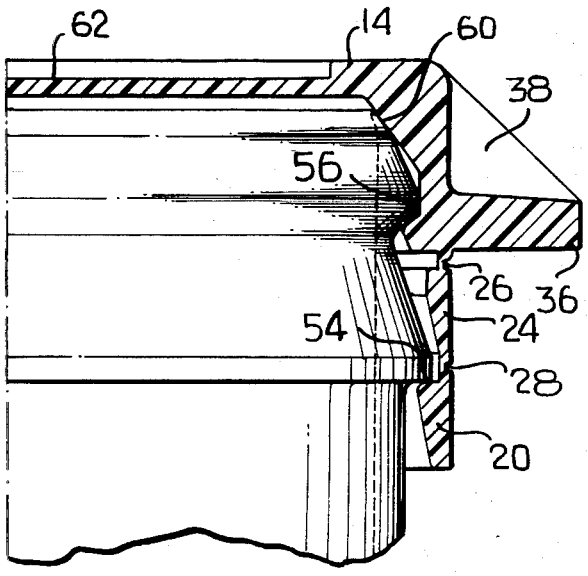
FIG. 2 is an enlarged fragmentary vertical sectional view taken through the closure and neck finish of the bottle generally along the line 2—2 of FIG. 1.
Figure 3:
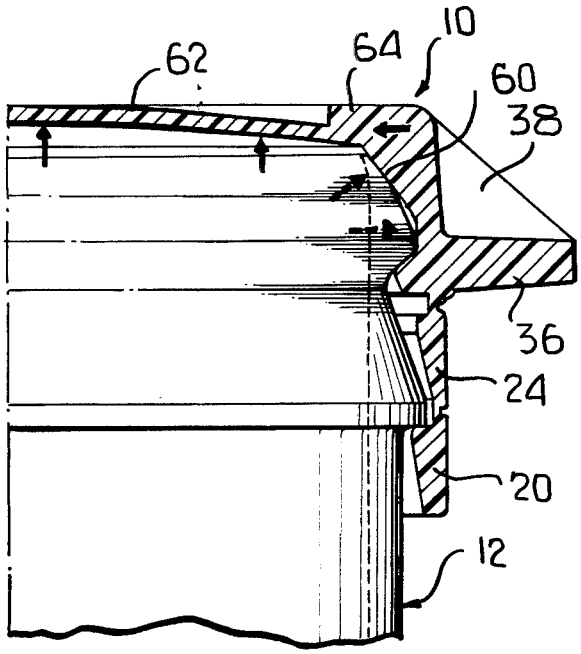
FIG. 3 is an enlarged fragmentary sectional view taken through the closure and neck portion of the bottle, showing the closure deformed under pressure.
Figure 4:
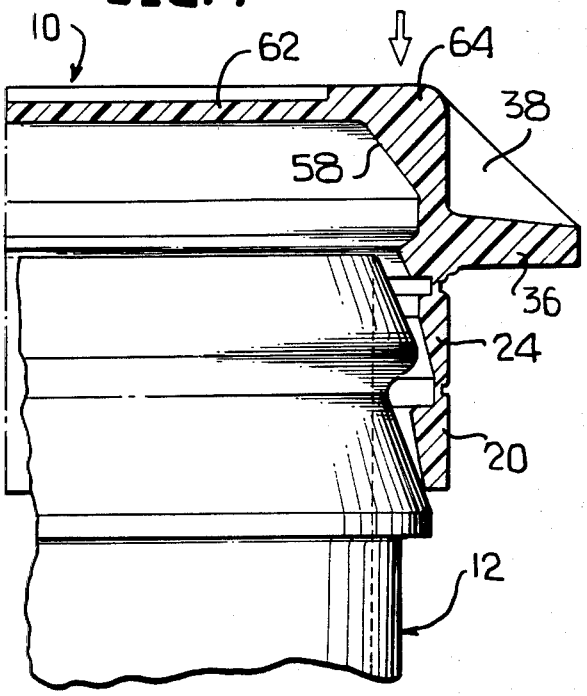
FIG. 4 is an enlarged fragmentary sectional view simlar to FIG. 3 showing the closure and bottle in partially assembled relation.
Figure 5:
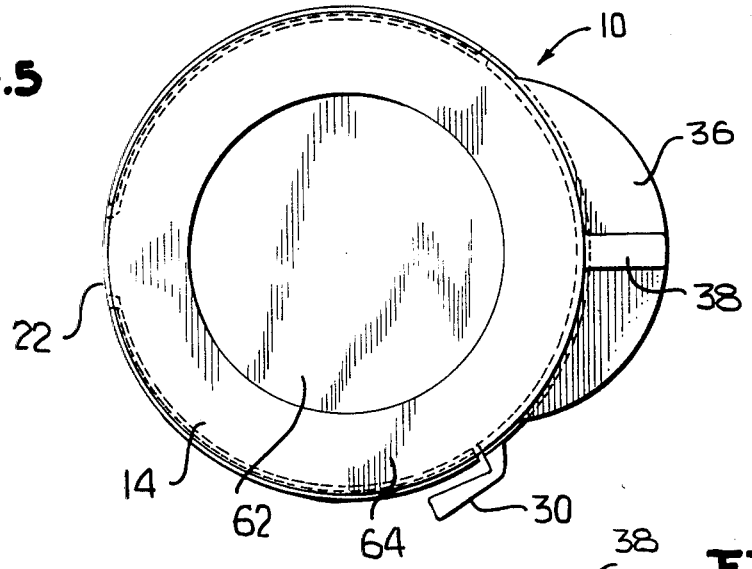
FIG. 5 is a top plan view of the closure and shows further the details thereof.

Returning now to FIG. 2, it will be seen that the lower portions of the tear strip and the retaining band are of a lesser radial thickness than the upper portion of the retaining ring 20 so that an upwardly facing shoulder 54 is formed on the retaining ring 20 for engagement with the shoulder 44 to hold the retaining ring 20 on the container at all times.

It will also be seen that the internal configuration of the lower portion of the skirt 16 is such as to define an upwardly and radially inwardly directed shoulder 56 which is interlocked beneath the shoulder 50. The interlocking shoulders 50, 56 from the primary means for retaining the closure 10 on the container 12. However, until such time as the tear strip 24 is removed. The retaining ring 20 also aids in the retention of the closure on the container.

Most particularly, it is to be noted that the upper part of the inner surface of the skirt 16 is tapered upwardly and radially inwardly to define a wedge surface 58. This wedge surface 58 engages the lip portion of the neck finish of the container 12 and forms a seal therewith. It will be seen that the wedge surface 58 engages the tapered surface 52 and forcibly deflects the extreme upper lip portion of the closure 12 radially inwardly with a seal 60 being formed between the wedge surface 58 and the tapered surface 52. It will be seen that the deflection of the lip portion of the neck finish of the container 12 provides a resilient sealing effect and therefore the seal is maintained over a period of time.

It is acknowledged that plastics materials have a tendency to creep over a period of time and that under certain conditions the plastics material of the lip portion of the container 12 will have a tendency to expand due to the internal pressure in the bottle, and therefore the pressure engagement in the area of the seal will increase. At the same time, because the closure 10 is formed of a resilient deformable plastics material, and by forming the end panels 14 of a thinness wherein it will deflect axially under pressure within the container, it will be seen that the upper part of the skirt 16 will be constantly drawn inwardly so that the wedge surface 58 will always exert a pressure on the lip portion of the container to maintain the seal 60. Thus, actually the internal pressure results in a tighter seal as opposed to the normal condition of the internal pressure acting against any effective seal being formed.

The closure 10 has a further benefit in that it may be readily applied to the container 12 without damaging the container. Existing metal caps require up to 500 pounds axial load for application. This high loading unduly stresses the container and frequently results in rupture. Considerably lower axial loads are required to apply the closure 10, axial loads on the order of 30–40 pounds being possible. This, of course, will greatly reduce container rupture during the application of the closures.

In practical uses, the interlock between the skirt 16 and the neck finish of the container 12 will be sufficient to retain the closure cap thereon. However, if the container is warm or has been shaken prior to opening, there is a pressure build-up in the container which could exceed the holding power of the skirt 16. Under these conditions, the retaining ring 20 will hold the closure cap in place. However, when the tear strip 24 is removed, this releases the retaining ring 20 from the skirt 16 with the result that the closure cap 10 can, in such abnormal circumstances, blow off. By having the closure retained with respect to the container at all times by the retaining ring 20, such blowing off of the closure will not form a dangerous hazard in that the closure will merely hinge relative to the retaining band and will not strike anyone or anything.

It is also pointed out at this time that while the end panel 14 has a central portion 62 of a reduced thickness, there is a raised peripheral portion 64 which could have suitable lettering either applied thereto or on the raised portion 64 in the form of molded lettering. In a like manner, since the periphery of the upper portion of the skirt 16 is also normally smooth, it may also be provided with suitable lettering either applied thereto or molded therewith. The lettering may be utilized either for instruction purposes or advertising purposes.

It is also to be understood that even with the tear strip removed the closure is effective for resealing purposes in that the interlock between the skirt and the neck finish will maintain the closure in place with the lip portion of the container deflected in the manner illustrated, and that any retained pressure within the container, as normally occurs with carbonated beverages, will still aid in maintaining the seal. Thus, the closure-container arrangement provides for extended resealed life of carbonated beverages and the like.

Although only a preferred embodiment of the closure and its relation to a specific container has been specifically illustrated and described, it is to be understood that minor modifications may be made in either the closure or the container without departing from the spirit and scope of the invention as defined in the appended claims.

I claim:

1. A pressurized container and closure therefor combination, said container including a neck terminating in a lip defining a mouth, said neck having an external finish, said container and said closure each being formed of a resiliently deformable plastics material, said closure cap including an end panel and a depending skirt, said skirt having an inner surface including an upper portion and a lower portion, said skirt surface lower inner portion having thereon closure means in interlocking engagement with said neck finish for retaining said closure on said neck, and said skirt inner surface upper portion defining an inwardly and upwardly sloping wedge surface means for engaging said container lip and forming a resilient seal therewith, said end panel being of a reduced thickness radially inwardly of said wedge surface means and is axially outwardly bowed under pressure from within said container with said wedge surface means being drawn radially inwardly.

2. A closure for containers formed of deformable resilient material, said closure being molded of resiliently deformable plastics material and including an end panel and a depending skirt, said skirt having an inner surface including an upper portion and a lower portion, said skirt inner surface lower portion having thereon retaining means for interlocking engagement with a container neck finish, and said skirt inner surface upper portion defining an inwardly and upwardly sloping wedge surface means for engaging a container upper lip to form therewith a resilient seal, said end panel within the inner outline of said wedge surface means being of a reduced thickness as compared to adjacent outer portions of said end panel and said skirt wherein in place on a pressurized container said end panel will deform axially at room temperature under pressure thereon and draw said wedge surface means radially inwardly to increase the radial pressure of the seal.

3. A pressurized container and closure therefor combination, said container including a neck terminating in a lip defining a mouth, said neck having an external finish, said container and said closure each being formed of a resiliently deformable plastics material, said closure cap including an end panel and a depending skirt, said skirt having an inner surface including an upper portion and a lower portion, said skirt inner surface lower portion having thereon closure means in interlocking engagement with said neck finish for retaining said closure on said neck, and said skirt inner surface upper portion defining an inwardly and upwardly sloping wedge surface means for engaging said container lip and forming a resilient seal therewith, said container being internally pressurized at room temperature, both said neck finish and said wedge surface means being conical with said wedge surface means being of a lesser angle to the horizontal than the angle of said conical neck finish.

4. A closure for containers formed of deformable resilient material, said closure being dimensioned for use with a container neck finish terminal portion of preselected internal and external diameters, said closure being molded of resiliently deformable plastics material and including an end panel and a depending skirt, said skirt having an inner surface including an upper portion and a lower portion, said skirt inner surface lower portion having thereon retaining means for interlocking engagement with a container neck finish, and said skirt inner surface upper portion defining an inwardly and upwardly sloping wedge surface means for engaging a container upper lip to form therewith a resilient seal, said wedge surface means having an upper diameter positively less than the preselected internal diameter of the intended container lip with said end panel under surface being of a lesser external diameter than a mouth of the preselected container wherein said end panel under surface is intended to remain free of an associated container at all times.

5. A pressurized container and closure therefor combination, said container including a neck terminating in a lip defining a mouth, said neck having an external finish, said container and said closure each being formed of a resiliently deformable plastics material, said closure cap including an end panel and a depending skirt, said skirt having an inner surface including an upper portion and a lower portion, said skirt inner surface lower portion having thereon closure means in interlocking engagement with said neck finish for retaining said closure on said neck, and said skirt inner surface upper portion defining an inwardly and upwardly sloping wedge surface means for engaging said container lip and forming a resilient seal therewith, said container lip being radially inwardly deformed upon formation of said resilient seal, said lip being thin as compared to the wall thickness of other portions of said neck finish with said neck finish forming said lip having a tapered outer surface, said resilient seal being a continuous area of contact between said wedge surface means and said lip, said area of contact being the sole seal between said closure and said pressurized container.

6. The combination of claim 5 wherein said skirt has a lower extension at least in part in the form of a removable tear strip for securing said closure cap against release at high internal pressures, there is disposed between said tear strip a retaining ring, said retaining ring being directly secured to said skirt for preventing separation of said closure cap from an associated container, said retaining ring having an annular shoulder engaged below a cooperating shoulder on said neck finish.

7. The combination of claim 5 wherein both said neck finish and said wedge surface means are conical with said wedge surface means being of a lesser angle to the horizontal than said neck finish.

8. The combination of claim 5 wherein said skirt has a lower extension at least in part in the form of a removable tear strip for securing said closure cap against high internal pressures, said lower extension having an annular shoulder engaged below said cooperating shoulder on said neck finish.

9. The combination of claim 5 wherein said container is internally pressurized at room temperature.

10. The combination of claim 5 wherein said container is internally pressurized at room temperature and contains a carbonated beverage.

11. The combination of claim 5 wherein both said neck finish and said wedge surface means are conical.

12. The combination of claim 5 wherein said end panel within the inner outline of said wedge surface means is of a thickness wherein said end panel is deformed axially and draws said wedge surface means radially inwardly to increase the radial pressure of said seal.

13. The combination of claim 5 wherein said end panel is of a reduced thickness radially inwardly of said wedge surface means and is axially outwardly bowed under pressure from within said container with said wedge surface means being drawn radially inwardly.

* * * * *